US009103629B2

(12) United States Patent
Axerud

(10) Patent No.: US 9,103,629 B2
(45) Date of Patent: Aug. 11, 2015

(54) WEAPON FIRING AND TARGET SIMULATOR AND METHODS THEREOF

(75) Inventor: Alf Axerud, Huskvarna (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 14/364,025

(22) PCT Filed: Dec. 13, 2011

(86) PCT No.: PCT/SE2011/051506

§ 371 (c)(1),
(2), (4) Date: Aug. 6, 2014

(87) PCT Pub. No.: WO2013/089600

PCT Pub. Date: Jun. 20, 2013

(65) Prior Publication Data

US 2014/0370466 A1 Dec. 18, 2014

(51) Int. Cl.

| | |
|---|---|
| ***F41A 33/00*** | (2006.01) |
| ***F41G 3/26*** | (2006.01) |
| ***F41J 5/02*** | (2006.01) |
| ***F41A 33/02*** | (2006.01) |

(52) U.S. Cl.

CPC ..... *F41G 3/265* (2013.01); *F41A 33/02* (2013.01); *F41G 3/2666* (2013.01); *F41G 3/2683* (2013.01); *F41J 5/02* (2013.01)

(58) Field of Classification Search

CPC ..... F41A 33/00; F41A 33/02; F41G 3/26; G01B 11/26; G01B 11/2616

USPC ..... 434/11–26

See application file for complete search history.

(56) References Cited

U.S. PATENT DOCUMENTS

| | | | |
|---|---|---|---|
| 4,218,834 | A | 8/1980 | Robertsson |
| 2009/0035730 | A1 | 2/2009 | Lindero |
| 2010/0261145 | A1 | 10/2010 | Isoz et al. |
| 2010/0297589 | A1 | 11/2010 | Ruud |

OTHER PUBLICATIONS

International Searching Authority, International Search Report and Written Opinion for International Application No. PCT/SE2011/051506, Jul. 23, 2012, 13 pages, Swedish Patent and Registration Office.

International Preliminary Examining Authority, International Preliminary Report on Patentability for International Application No. PCT/SE2011/051506, Mar. 14, 2014, 10 pages, Swedish Patent and Registration Office.

*Primary Examiner* — Timothy A Musselman
(74) *Attorney, Agent, or Firm* — Alston & Bird LLP

(57) ABSTRACT

The present invention describes a weapon firing simulator comprising a laser transmitter arranged to emit a light beam triggered by a simulated firing, wherein the laser transmitter has sweeping means arranged for sweeping the emitted light beam typically around the simulated projectile or missile, the laser transmitter has modifying means arranged for modifying the emitted light beam to contain information, for transmission of a simulated engagement coordinate.

15 Claims, 10 Drawing Sheets

WEAPON FIRING AND TARGET SIMULATOR AND METHODS THEREOF

CROSS REFERENCE TO RELATED APPLICATIONS

This application is a National Stage Application, filed under 35 U.S.C. §371, of International Application No. PCT/SE2011/051506, filed Dec. 13, 2011, the contents of which are hereby incorporated by reference in their entirety.

BACKGROUND

1. Related Field

The present invention relates to a weapon firing simulator and its corresponding method and a weapon target simulator and its corresponding method. In particular, the invention relates to simulating against targets by a single lobe scanning laser transmitter to determine the plurality of information such as, but not limited to, position of a simulated projectile or missile, ammunition type, distance from engager to target, distance from ammunition detonation to target, and identification of firing simulator.

2. Description of Related Art

Weapon firing simulator systems are generally employed for giving training to trainees. The trainees are typically provided with real firearms, with virtual fire capability along with a simulated real life scenario. During the training the trainees use laser light to engage targets instead of real bullets. In general, the simulated weapons used in simulated real life scenarios are laser based fire simulators which comprise of laser transmitters. The laser transmitter transmits engagement info towards the targets when the fire trigger is actuated by the trainee or at time of simulated target impact. Thereafter the engagement effect on the targets is communicated to the weapon target simulation computer by means of plurality detectors mounted on to a target system.

Typically, there are two types of laser simulators i.e. Two-way Laser simulator and One-way Laser simulator. The Two-way Laser simulator includes retro-reflectors at the target and the laser light travels both from and to the fire simulator. On other hand, the One-way Laser simulator does not include retro-reflectors at the target and the laser light travels only in one direction i.e. from the transmitter to the target.

Conventionally, the laser transmitter transmits the laser beam which comprises of a laser lobe. The laser lobe is a compilation of different intensities in different directions of radiation. While typically following the simulated projectile or missile with the scanning laser beam towards the target the trainee fire simulator scans the target system by means of the laser lobes and when the radiant intensity from the laser lobe at a particular distance from the emitter and in a particular direction exceeds a detection level at any detector on the target, a simulated effect of firing with the weapon towards the target system that lies in the said direction and at the said distance is obtained.

The laser transmitter consists of one or more fan shaped or round shaped laser lobes. However, the laser lobes may be of any other shape and dimensions. FIG. 1*a* &*b* illustrates scanning performed by three fan shaped Laser lobes of a know laser transmitter. In the lobe pattern shown in FIG. 1*a*, the two outer orthogonal lobes is constructing the basis for an x-y coordinate system used by the weapon simulator to present e.g. a simulated projectile or missile position to the target system(s). The weapon simulator is continuously pre-calculating the simulated projectile or missile position coordinate during the scanning and in case the Laser lobes are passing one or more target detector(s) the simulated projectile or missile position is automatically transferred as shown in FIG. 1*b*. In case there are only Two-way weapon target simulators in the training area, the simulated projectile or missile position is typically transferred only in case of Laser light reflection, as the target detector and the retro-reflector are mounted close to one another. However, in such type of system two or more laser lobes are required to scan the target and accumulated information is transferred to the transmitter. This process requires cumbersome process of combining information retrieved by each of the lobe during scanning and analysis of such combined information requires a significant time to complete.

Patent document U.S. Pat. No. 4,218,834 describes a military training system for scoring a simulated weapon firing. The type of simulation disclosed in the patent is usually applied as a real time type of simulation as scanning fan shaped Laser beams usually follows the simulated flying projectile or missile during its time of flight. This system provides information about the projectile or missile position however it utilizes plurality of laser lobes to determine the position information.

Therefore, there is a need of an improved cost effective weapon simulation system which utilizes minimum number of laser lobes to scan the target system and provides projectile or missile information accurately in minimal time.

BRIEF SUMMARY

The object of the present invention is to provide an inventive weapon simulation system where one single laser lobe is used for scanning in different directions to transfer simulated projectile or missile position coordinate. This object is achieved by a weapon firing simulator. The weapon firing simulator comprises of a laser transmitter arranged to emit a light beam triggered by a simulated firing for transmission related to a simulated projectile or missile engagement coordinate. The laser transmitter has sweeping means arranged for sweeping the emitted light beam over the simulated projectile or missile, in other words sweeping is typically done around the simulated projectile or missile and modifying means arranged for modifying the emitted light beam to contain information.

Further, the weapon firing simulator is arranged to build a message formed of a sequence of sweeps containing different types of information. The light beam in each of the individual sweep is modified to contain at least one type of information, where each of the individual sweeps contains different types of information. A sequence of sweeps carrying different information in each individual sweep are combined together in order to build the message.

Preferably, the type of information may be related to, but not limited to, position of a simulated projectile or missile, ammunition type, distance from engager to target, distance from ammunition detonation to target and identification of firing simulator.

In one of the advantageous embodiment of the invention, the transmission is a spatially encoded transmission centred around the simulated projectile or missile for enablement of calculation of measured engagement coordinates by a target and/or reflection back to the firing simulator.

In yet another advantageous embodiment of the invention the weapon firing simulator transmits at least one message if the distance from the transmitter to a simulated target is known. In other words, weapon firing simulator transmits at least one message when the simulated projectile or missile distance is close to target and such distance is known. And, if the distance from the transmitter to the simulated target is unknown then the weapon firing simulator repeatedly transmit a message through the simulated projectile or missile flight path. Further, if the distance from the transmitter to the simulated target is unknown the weapon firing simulator typically changes at least one part of the message for each subsequent transmission.

In one of the preferred embodiment of the invention the weapon firing simulator encloses a target and its vicinity with an imaginary optical volume constructed by the emitted and received light beam when a simulated projectile or missile is near the target. This enables the weapon target simulators to provide information regarding the real-time position of the projectile or missile to the simulated target(s). In other words, the simulated target analyze the effect of the engagement by means of the imaginary optical volume enclosing the target and its vicinity and the weapon firing simulator emits the light beam with such a message to present the projectile or missile position in the nearby area of the target(s).

In another advantageous embodiment of the invention the transmitter has receiver means and the simulated target has reflection means. Further, the receiver means at the transmitter are adapted to receive the light reflected from a simulated target, where the receiver means read the message carried by the reflected light and calculates the distance from engager to target and the simulated engagement coordinates.

In yet another advantageous embodiment of the invention the weapon firing simulator has compensation means for compensation of transmitter movements, after a simulated firing during a simulated projectile or missile flight until reaching a simulated target engagement.

Said objective is further achieved by a weapon target simulator. The weapon target simulator comprises of at least one laser receiver arranged to receive a light beam from a simulated firing by a laser transmitter of the weapon firing simulator in order to carry out translation into a simulation of a simulated projectile or missile engagement coordinate and outcome. The laser receiver has receiving means arranged to receive a modified light beam swept over the receiver and has interpreting means arranged to interpret the received modified light beam into information.

Further, the laser receiver has separating means for separating individual sweeps in a sequence of sweeps built to a message and has interpreting means for interpreting the information in each individual sweep.

Preferably, the laser receiver has interpreting means for interpretation of information such as, but not limited to position of a simulated projectile or missile, ammunition type, distance from engager to target, distance from ammunition detonation to target and identification of firing simulator.

In accordance with one of the advantageous embodiment of the invention, the interpreting means of the laser receiver arranged to interpret a simulated projectile or missile engagement coordinate in a vicinity of the receiver for simulation of the passing projectile or missile.

The objective of the present invention is also to provide a weapon firing simulator method. The method comprising the steps of triggering a simulated firing and emitting a light beam from a laser transmitter where the light beam is modified to contain information. Thereafter, the laser transmitter light beam sweeps typically around a simulated projectile or missile and the transmitted information is provided as a spatially encoded projectile or missile position coordinate.

Further, the weapon firing simulator method comprising the step of building a message formed of a sequence of sweeps containing different types of information. Wherein the step of building a message includes modifying the light beam in each individual sweep to contain at least one type of information, where each individual sweep contains different types of information and building the message of a sequence of sweeps carrying different information in each individual sweep.

The object of the present invention is further achieved by a weapon target simulator method. The method comprising the steps of receiving a modified light beam swept over at least one laser receiver, where the laser receiver is arranged to receive a light beam from a simulated firing by a laser transmitter, interpreting the information received by the laser receiver from the modified light beam and translating the interpreted information into a simulated projectile or missile engagement coordinate, ammunition type, fire simulator identity, distance from engager to target, distance from ammunition detonation to target, etc.

Further, the weapon target simulator performs the steps of separating individual sweeps in a sequence of sweeps and interpretation of the information in each individual sweep. Finally the received sequence of sweeps is evaluated as an engagement outcome.

BRIEF DESCRIPTION OF THE FIGURES

The present invention will now be described in detail with reference to the figures, wherein.

DETAILED DESCRIPTION OF VARIOUS EMBODIMENTS

Various embodiments of the invention will hereinafter be described in conjunction with the appended drawings provided to illustrate and not to limit the invention, wherein like designations denote like elements, and variations of the embodiments are not restricted to the specific shown embodiment, but are applicable on other variations of the invention.

Figure 1A:
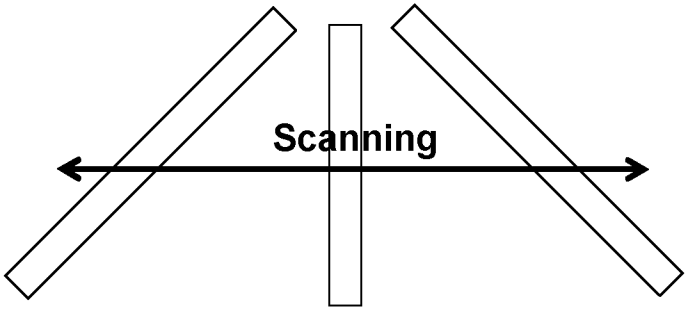
FIG. 1a (Prior Art)
FIG. 1*a*&*b* illustrates scanning performed by three fan shaped Laser lobes of a know laser transmitter.
Figure 1B:
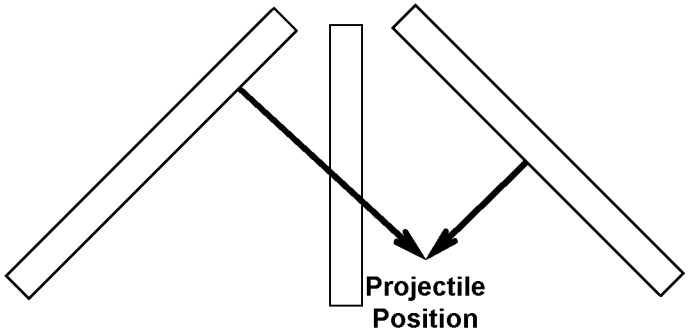
FIG. 1b (Prior Art)
Figure 2:
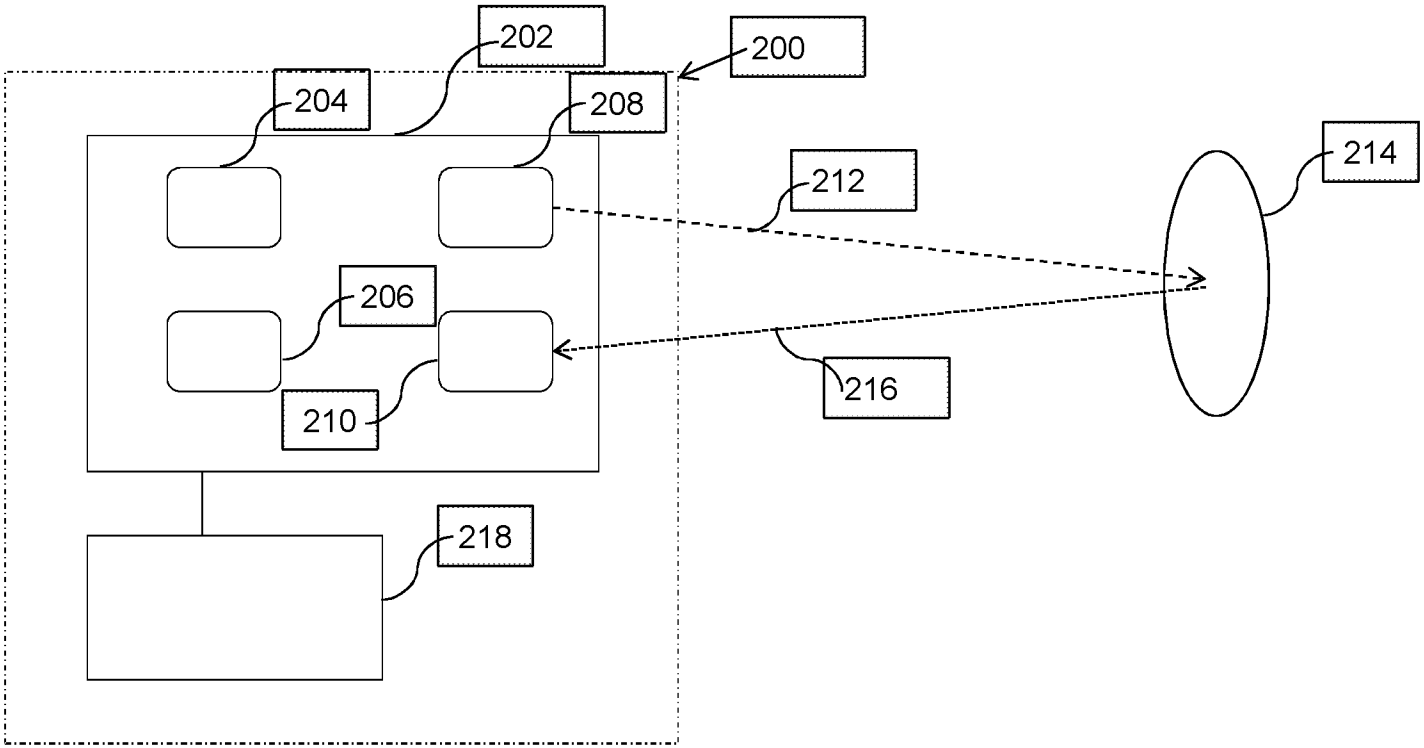
FIG. 2 illustrates a weapon firing simulator in accordance with one of the preferred embodiment of the present invention.

FIG. 2 illustrates a schematic diagram of a weapon firing simulator 200 in accordance with one of the preferred embodiment of the present invention. The weapon firing simulator 200 as shown in FIG. 2 comprises of a laser transmitter 202 which emits a laser light beam 212 towards a simulated target engagement area 214. Further, the weapon firing simulator 200 comprises of compensation means 218.

The laser transmitter 202 comprises of a sweeping means 204, a modifying means 206, a transmission means 208 and a receiving means 210.

In accordance with one of the embodiment of the invention, the sweeping means 204 may be any computer and/or electronically controlled device, wherein such device performs sweeping of the emitted laser light beam 212 over the simulated target engagement area 214. This sweeping of the laser light beam 212 over the simulated target engagement area 214 provides the information related to a simulated projectile or missile engagement coordinate. In other words, sweeping means 204 swept the laser light beam 212 over the simulated target engagement area 214 and is providing with the simulated projectile or missile engagement coordinate from the modifying means 206.

In accordance with one of the embodiment of the invention, the modifying means 206 may be any computer and/or electronically controlled device, wherein such device modifies the laser light beam 212 in order to contain specific information as required during the exercise of simulated firing. The light beam 212 may be modified by modifying the value of pulse width, pulse interval, frequency, wavelength, incident angle of the light beam, polarization of beam etc.

In accordance with one of the embodiment of the invention, the transmission means 208 transmits the modified light beam 212 towards the simulated target engagement area 214.

Figure 6:
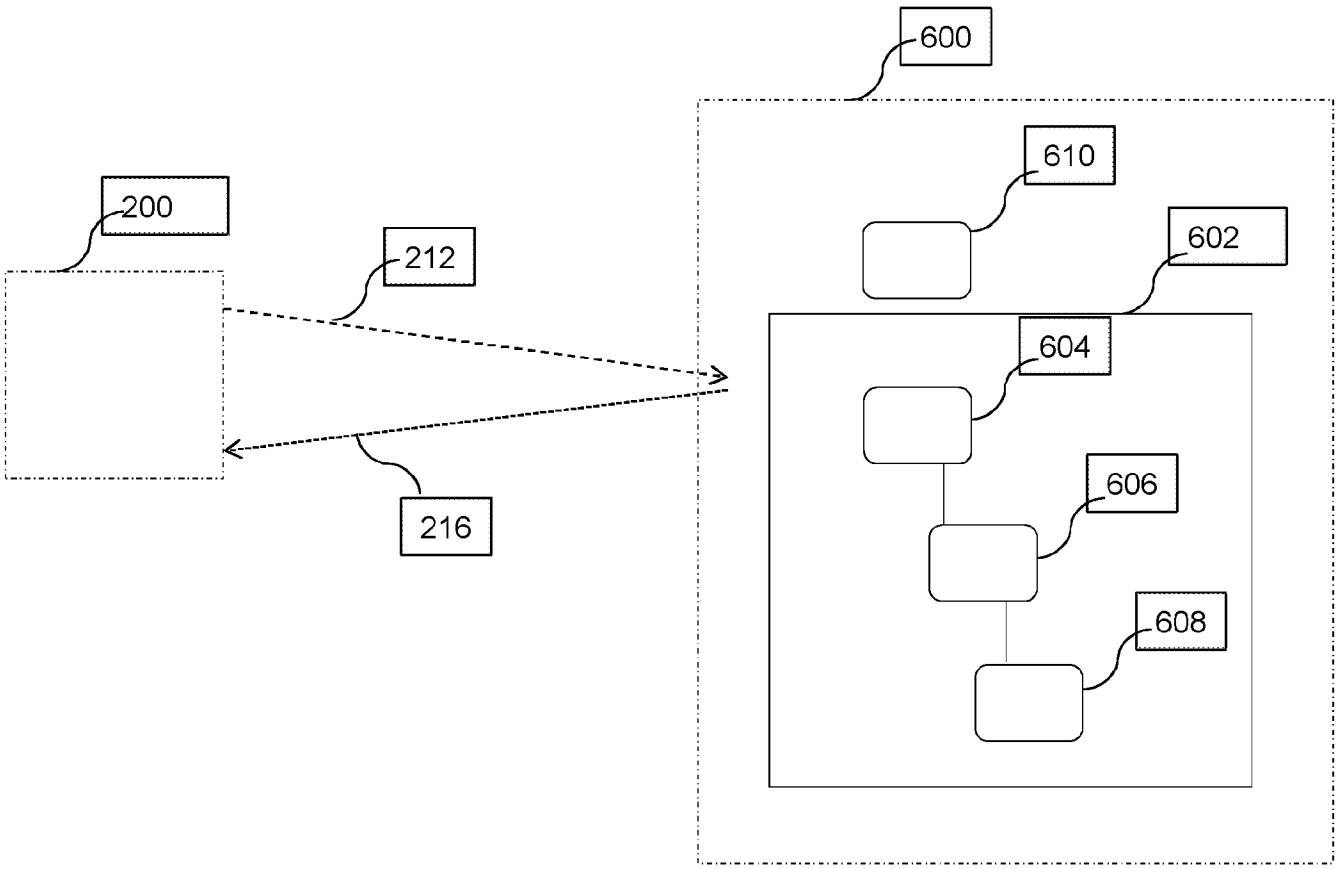
FIG. 6 illustrates a weapon target simulator in accordance with one of the preferred embodiment of the present invention.

In accordance with one of the embodiment of the invention, the receiving means 210 receives a light beam 216 reflected by one of the weapon target simulator(s) 600 in case retro-reflector(s) 610 are included (see FIG. 6). The receiving means 210 has computer controlled and/or electronic sensors in order to read the message carried by the light beam 216 and generates a visual and/or audio output confirming a simulated projectile or missile engagement coordinate.

The compensation means 218 may be any computer and/or electronically controlled device which provides compensating signals to the laser transmitter 202 in order to accurately measure the laser transmitter 202 movement during simulated projectile or missile flight.

Figure 3:
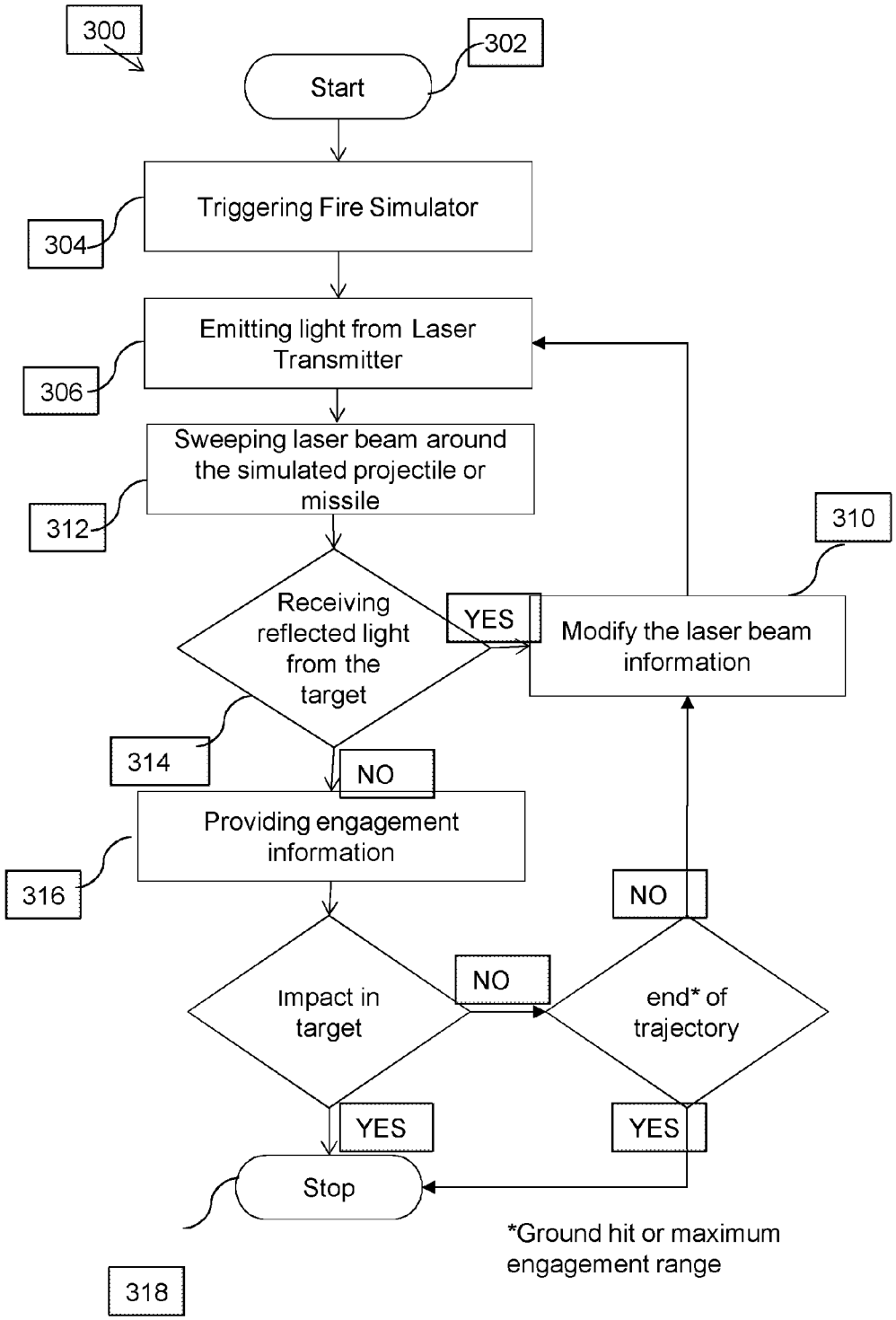
FIG. 3 shows a flow chart describing a weapon firing simulator method in accordance with one of the preferred embodiment of the present invention.

FIG. 3 shows a flow chart describing a weapon firing simulator method in accordance with one of the preferred embodiment of the present invention. The method initiates at step 302. At step 304, the weapon firing simulator 200 is triggered by a trainee. At Step 306, the laser transmitter 202 transmits the laser light beam 212 towards the simulated target engagement area 214. In other words, the laser light beam 212 is transmitted by the laser transmitter 202 when the weapon firing simulator 200 is triggered.

Further at step 314, the modifying means 206, check if the laser light beam 212 is to be modified or not, in order to contain specific information before transmission. Thereafter, at step 310, the laser light beam 212 is modified to contain appropriate information.

In accordance with one of the preferred embodiment of the present invention, laser light beam 212 may be modified by modifying the characteristics of the laser light beam 212 such as, but not limited to, pulse width, pulse interval, frequency, wavelength, incident angle of the light beam, polarization of beam etc.

In accordance with one of the preferred embodiment of the present invention, the laser light beam 212 contains different types of information such as, but not limited to, position of a simulated projectile or missile, ammunition type, distance from engager to target, distance from ammunition detonation to target, and identification of firing simulator. Such information transmitted by the weapon firing simulator 200 is a type of coded information which is received by the weapon target simulator(s) 600 during firing simulation. In general, there are two groups of coded information which includes five basic types of optical engagement codes as described in e.g. the "OSAG 2.0 Standard Optical Interface Specification". The optical engagement codes are briefly discussed below:

1. Short-Time Group Coded: This group is typically used by none scanning Laser simulators and other Laser equipment like umpire guns and is typically used by Small Arms Transmitters and the Umpire Gun Transmitters.

2. Triplet Group Coded: This group is typically used by scanning Laser simulators and is typically used as summarized below:

a. Real-Time Code: It is used when simulating projectiles or missiles, where the simulator in real time follows the projectile or missile until target impact. All nearby targets typically receive:
   ammo number
   player identity
   distance from engager to target
   target engagement coordinates (individual for each target)
   cant angle
b. Fire-and-Forget Code: It is used when simulating Fire-and-Forget type of weapon systems. The target typically receives:
   ammo number
   player identity
   distance from engager to target
   hit probability code
   time until impact
c. Short-Time Scanning Code: It is used when simulating against man worn target simulators without retro reflectors. The scanning Laser fire simulator constructs an engagement area, where the man worn simulators shall be engaged. All nearby man worn targets receive:
   ammo number
   player identity Further, at step 312, sweeping of the transmitted laser light beam 212 is performed over the simulated target engagement area 214.

In accordance with one of the embodiment of the present invention, a message is build by a sequence of sweeps containing different types of information. Wherein, the laser light beam in each individual sweep is modified to contain at least one type of information (discussed above). Further, each individual sweep contains different types of information.

Thereafter, at step 314, the reflected light beam 216 is received by the receiving means 210 of the laser transmitter 202 and the information carried out by the light beam 216 is analysed by the receiving means 210.

At step 316, the simulation firing results is provided by visual and/or audio output i.e. providing simulation of a projectile or missile engagement coordinate.

Figure 4A:
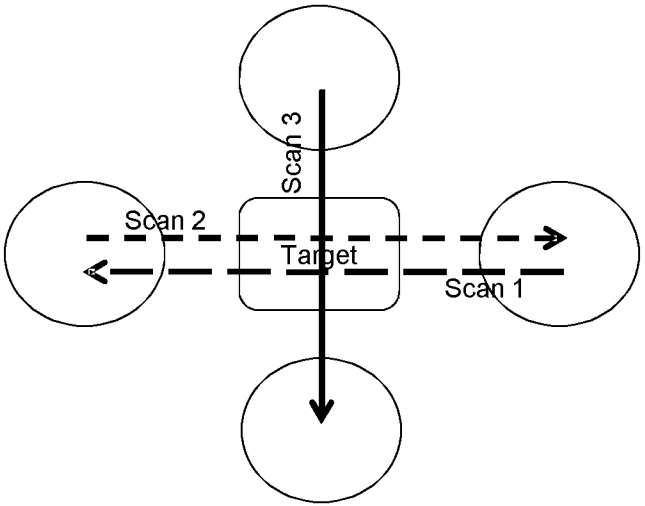
FIG. 4*a*&*b*&*c* illustrates scanning performed by one single laser lobe in accordance with one of the preferred embodiment of the present invention.

In order to understand, consider a scenario as shown in FIG. 4*a*&*b*&*c*, where a laser light beam transmitted from the laser transmitter 202 consists of one round shaped Laser lobe. The Laser lobe transmits one or several information types in each Laser lobe scan that can be identified by the weapon target simulator(s) 600. To accept a complete received message, the weapon target simulator(s) 600 can decide to receive one or multiple information types from one or several Laser lobe scans.

In one of the advantageous embodiment of the invention, a simulated projectile or a missile is enclosed by a three dimensional coordinate system with the origin at the projectile or missile. This enable targets to calculate the relative position coordinate to a projectile or missile and evaluate if it is passing or engaging.

The Laser transmitter 202 transmits unique optical coded coordinate information as e.g. projectile or missile position and in that case also different Laser lobe scan directions shall be used, as shown in FIG. 4*a*. To accept a complete received simulated projectile or missile position coordinate, the weapon target simulator(s) 600 has to receive information transmitted by the Laser lobe of the laser transmitter 202 when it is scanning in at least two different directions. In case of a round laser lobe transmitting a projectile or missile position coordinate the ideal two scan directions are orthogonal to each other, as shown in FIG. 4*a*.

Figure 4B:
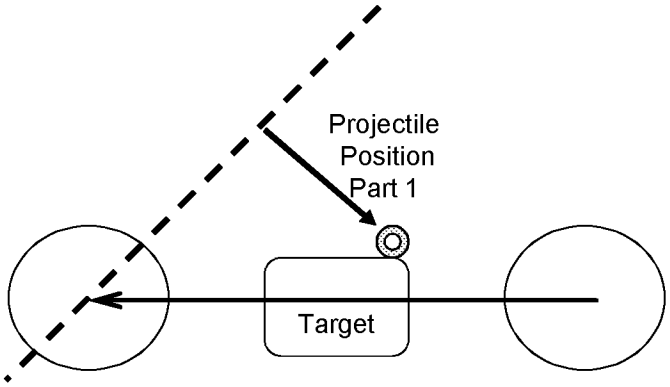
Figure 4C:
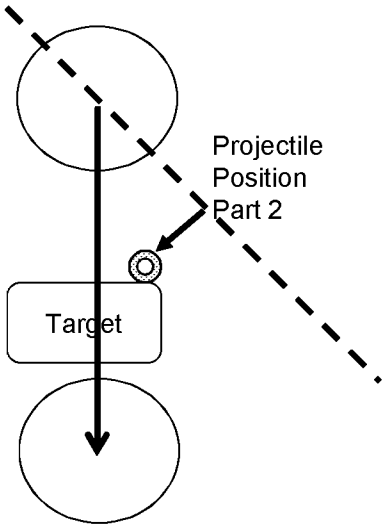

In accordance with another embodiment of the present invention, the weapon firing simulator is continuously pre-calculating the simulated projectile or missile position coordinate during at least two scans in different directions and in case the Laser lobes are passing the target detector at the simulated target the simulated projectile or missile position is automatically transferred. FIG. 4*b* illustrates scanning performed by the weapon firing simulator in horizontal direction to determine pre-calculated simulated projectile or missile position coordinate and FIG. 4*c* illustrates scanning performed by the weapon firing simulator in vertical direction to determine pre-calculated simulated projectile or missile position coordinate.

In order to understand, consider a scenario, where a laser light beam is transmitted from the laser transmitter 202 consists of one round shaped laser lobe. During horizontal scan, when the laser lobe come across the target detector at the weapon target simulator(s) 600 it automatically transfers the simulated projectile or missile position information to the weapon firing simulator. Similarly, during vertical scan, when the laser lobe come across the target detector at the weapon target simulator(s) 600 it automatically transfers the simulated projectile or missile position information to the weapon firing simulator.

EXAMPLE

A complete message contains ammunition code and simulated projectile or missile position.

A Laser transmitter using one Laser lobe may transmit the engagement message using e.g. three scans as for example as follows:

Scan 1: Projectile or Missile Position Part 1

Scan 2: Ammunition Code

Scan 3: Projectile or Missile Position Part 2

The messages shall be transmitted in the direction of the simulated projectile or missile.

In accordance with another embodiment of the present invention, the message transmission can be done in two different ways depending on the status of the distance from the transmitter to the target i.e. whether known or unknown. In case, the distance between the transmitter and the target is unknown the messages are repeatedly transmitted at intervals during and following the simulated projectile or missile flight path. Whereas, if the distance from the transmitter to the target is known the messages are transmitted when the target distance is equal or near equal to the simulated projectile or missile distance.

Figure 5:
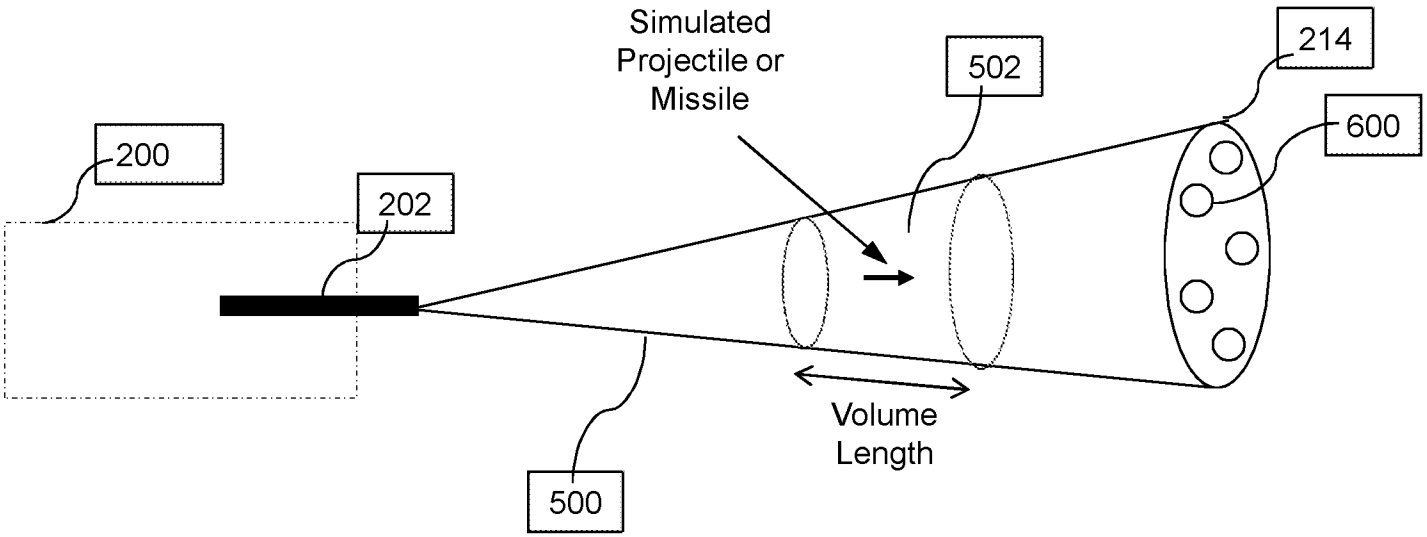
FIG. 5 illustrates a weapon firing simulator where the simulated projectile or missile imaginary optical volume is approaching the target(s) with one of the preferred embodiment of the present invention.

In accordance with another embodiment of the present invention, the weapon firing simulator 200 encloses a simulated target engagement area 214, with the weapon target simulator(s) 600, and its vicinity with an imaginary optical volume as shown in FIG. 5. The laser transmitter 202 of the weapon firing simulator 200 emits a laser beam 500. The laser beam contains at least one type of the information, wherein the type of information may be related to, but not limited to, position of a simulated projectile or missile, ammunition type, distance from engager to target, distance from ammunition detonation to target and identification of firing simulator. Once the beam is approaching the weapon target simulator(s) 600 the fire simulator creates the imaginary optical volume 502. In other words, the imaginary optical volume 502 is constructed by the emitted and received light beam when the simulated projectile or missile is near the target. The imaginary optical volume is an optical three dimensional volume and may also be referred as flying volume, where simulated projectile or missile typically is positioned in the centre of the volume.

As shown in the FIG. 5, as the imaginary optical volume 502 approaches the weapon target simulator(s) 600 and presenting the contained information to the weapon target simulators(s) 600 by enclosing the same in a particular volume length. Further, the presentation of volume is limited to the targets positioned within the volume covered by the imaginary optical volume 502.

Thereafter, the weapon target simulator(s) 600 analyses the information contained in the simulated projectile or missile and evaluates the effect of the engagement from the weapon firing simulator 200. This enables a trainee or trainer to analyze e.g. combat training behaviour in matters of as for example using the terrain, seeking cover, minimise the time exposed for enemy fire, judging opponents fire power, etc. and modify behaviour for successful combat mission.

In accordance with another embodiment of the present invention, the imaginary optical volume 502 may be customized in accordance with the specific simulated firing and target configuration, provided distance from the engager to the target is known.

Further, the information transmitted to the simulated target engagement area 214 with the weapon target simulator(s) 600 may be reflected back to the weapon firing simulator 200 by means of retro-reflector(s) 610 or by any other appropriate means. Thereafter, the weapon fire simulator 200 analyses the reflected information and evaluates the effect of the engagement against the weapon target simulator 600. This enables a trainee or trainer to determine the engagement position of the projectile or missile and e.g. correct the target aiming for successful engagement. It also enables a trainee or trainer to analyze the trainee ability to e.g. judge the opponents level of protection, minimise the possibility of being revealed to the enemy, etc. and modify behaviour for successful combat mission.

The various types of scanning codes and their respective message formats and coding are described in the enclosed Annex to the specification. However, the invention is not limited to the specific codes and messages described in the Annex, but include all variations within the scope of the present invention. Further, such codes and message formats can be modified in various obvious respects, all without departing from the scope of the present invention. Accordingly, the subject matter disclosed in the annex is to be regarded as illustrative in nature, and not restrictive.

FIG. 6 illustrates a weapon target simulator in accordance with one of the preferred embodiment of the present invention. The weapon target simulator 600 as shown in FIG. 6 comprises of at least one laser receiver 602 which receives a laser light beam 212 transmitted by the laser transmitter 202 of the weapon firing simulator 200.

The laser receiver 602 comprises of a receiving means 604, a separating means 606 and an interpreting means 608.

In accordance with one of the embodiment of the invention, the receiving means 604 may be any computer and/or electronically controlled device, wherein such device is arranged to receive the modified laser light beam 212 swept over the laser receiver 602.

In accordance with one of the embodiment of the invention, the separating means 606 may be any computer and/or electronically controlled device, wherein such device separates individual sweeps in a sequence of sweeps forming a message.

In accordance with one of the embodiment of the invention, the interpretation means 608 interprets the received modified light beam 212 and decodes the information contained in each of the individual sweeps.

In accordance with one of the embodiment of the invention, the weapon target simulator 600 may, in case of a Two-way type of Laser simulator, have retro-reflector(s) means 610 that reflects the received modified light beam 212 as a light beam 216 back to the weapon fire simulator 200.

In accordance with one of the embodiment of the invention, the type of information is similar to the information as e.g. previously referred to in the "OSAG 2.0 Standard Optical Interface Specification" and thus not described here for sake of brevity.

Further, in accordance with one of the embodiment of the invention the weapon target simulator 600 comprises of a receiver swept which provides information regarding simulation of the projectile or missile engagement position. The receiver swept has interpretation means for interpreting a projectile or missile engagement position in a vicinity of the receiver for simulation of a passing projectile or missile. In other words, the interpretation means of the receiver swept may provide results of passing the real target and provide information regarding the margins by which the trainer has missed the target.

Figure 7:
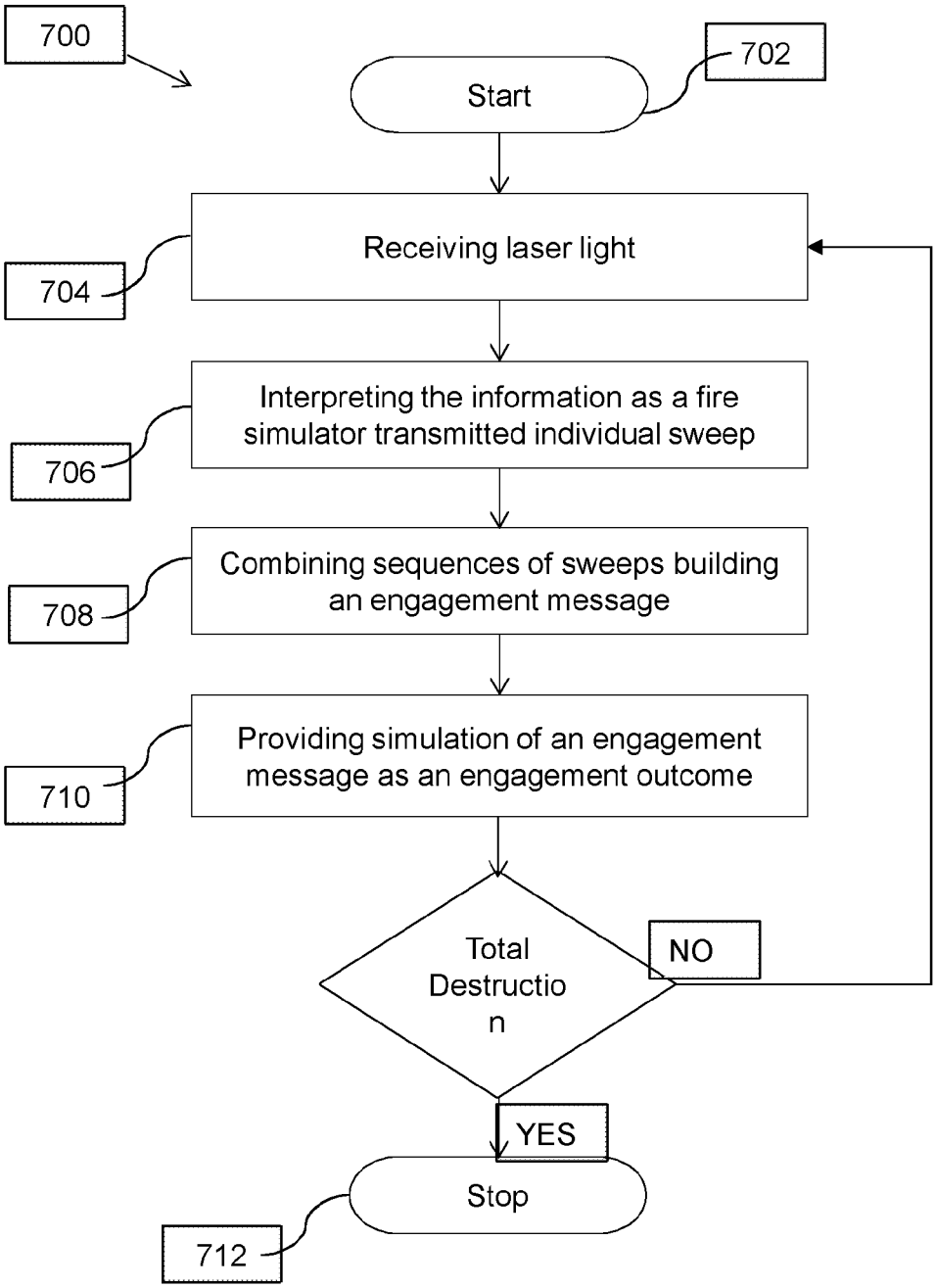
FIG. 7 shows a flow chart illustrating a weapon target simulator method in accordance with one of the preferred embodiment of the present invention.

FIG. 7 shows a flow chart describing a weapon target simulator method in accordance with one of the preferred embodiment of the present invention. The method initiates at step 702. At step 704, the weapon target simulator 600 receives the modified laser light beam 212 swept over the laser receiver 602. At Step 706, sequence of sweeps is separated into individual sweeps containing separate information from each other.

Further, at step 708, the information contained by the each of the sweep is interoperated and such information is decoded and/or translated in order to determine a simulation of a projectile or missile engagement coordinate, at step 710 evaluated as an engagement outcome. In other words, the coded information contained in the modified laser light beam is interpreted into the original message and the same is provided by the laser receiver 602 to the user, trainer, trainee etc by visual and/or audio means.

The disclosed weapon firing simulator and weapon target simulator may be employed in varied circumstances and for simulating various types of weapons such as, but not limited to, machine gun, recoilless rifle, weapons mounted on a vehicle etc.

The invention is not limited to the specific flowchart and embodiments presented, but include all variations within the scope of the present claims. The internal sequence of the steps for performing weapon firing simulation and weapon target simulation can of course be varied according to the demands of circumstances and scenarios of the type of simulation requirements.

As will be realised, it is possible to modify the invention in various obvious respects, all without departing from the scope of the appended claims. Accordingly, the drawings and the description thereto are to be regarded as illustrative in nature, and not restrictive.

The invention claimed is:

1. A weapon firing simulator comprising a laser transmitter configured to emit a single light beam triggered by a simulated firing, wherein:

the laser transmitter has sweeping means configured for sweeping the single emitted light beam over at least one of a simulated projectile or a missile;

the single emitted light beam is round shaped;

the single emitted light beam is swept over the at least one of the simulated projectile or the missile in at least two different directions, two of the at least two different directions being orthogonal relative to one another; and the laser transmitter has modifying means configured for modifying the single emitted light beam to contain at least one type of information, said information comprising at least one of a simulated projectile or missile engagement coordinate configured for transmission thereof.

2. The firing simulator according to claim 1, further configured to build a message formed of a sequence of sweeps containing different types of information, wherein:

the light beam in each individual sweep is modified to contain at least one type of information;

each individual sweep contains different types of information; and a sequence of sweeps, carrying different information in each individual sweep, together builds the message.

3. The firing simulator according to claim 1, wherein the transmission is a spatially encoded transmission centered around the at least one simulated projectile or missile, wherein the transmission is configured for at least one of:

enablement of calculation of measured engagement coordinates by a target; or reflection back to the firing simulator.

4. The firing simulator according to claim 1, wherein the type of information at least contains at least one of a position of the at least one simulated projectile or missile, an ammunition type, a distance from engager to target, a distance from ammunition detonation to target, or an identification of firing simulator.

5. The firing simulator according to claim 1, further configured to at least one of:

if the distance is known to a simulated target, transmit at least one message when the simulated projectile or missile distance is close to target distance; or if the distance is an unknown to a simulated target, repeatedly transmit the message through the simulated projectile or missile flight path.

6. The firing simulator according to claim 1, further configured to change a part of the message for each transmission.

7. The firing simulator according to claim 1, further configured to enclose the simulated projectile or missile by an imaginary optical volume by the emitted light beam, wherein the optical volume is activated when the simulated projectile or missile is near the target.

8. The firing simulator according to claim 1, wherein:

the transmitter has receiver means for receiving light reflected by a simulated target, if the target has reflection means, read the message carried by the light and calculate simulated target distance and engagement coordinate.

9. The firing simulator according to claim 1, wherein:

the firing simulator has compensation means for compensation of transmitter movements, after a simulated firing during a simulated projectile or missile flight until reaching a target engagement.

10. A weapon target simulator comprising at least one laser receiver configured to receive a light beam from a simulated firing by a laser transmitter, wherein:

the laser receiver comprises receiving means configured to receive a modified light beam swept over the receiver in at least two different directions;

two of the at least two different directions are orthogonal relative to each other;

the light beam is round shaped;

the laser receiver comprises interpreting means configured to interpret the received modified light beam into information by separating the individual sweeps in a sequence of sweeps and interpreting the information in each individual sweep, for translation into a simulation of at least one of a simulated projectile or missile engagement coordinate and outcome.

11. The target simulator according to claim 10, wherein the receiver has interpreting means for interpretation of at least one of:

projectile or missile position, ammunition type, distance from engager to target, distance from ammunition detonation to target, or identification of firing simulator.

12. The target simulator according to claim 10, wherein a receiver swept by light has interpreting means for interpreting a simulated projectile or missile engagement coordinate in a vicinity of the receiver for simulation of the passing projectile or missile.

13. A weapon firing simulator method comprising the steps of, triggered by a simulated firing:

emitting a single light beam from a laser transmitter, the light beam being modified to contain information;

sweeping, by the laser transmitter, the light beam, wherein the light beam is round shaped, over at least one of a simulated projectile or a missile, the sweeping occurring in at least two different directions, two of the at least two different directions being orthogonal to each other; and transmitting to a target for translation into a simulation of a projectile or missile engagement coordinate.

14. The firing simulator method according to claim 13, for building a message formed of a sequence of sweeps containing different types of information, the method further comprising the steps of:

modifying the light beam in each individual sweep to contain at least one type of information, wherein each individual sweep contains different types of information; and building the message of a sequence of sweeps carrying different information in each individual sweep.

15. A weapon target simulator method using at least one laser receiver configured to receive a light beam from a simulated firing by a laser transmitter, the method comprising the steps of:

receiving a modified light beam swept over the receiver in at least two different directions, two of the at least two different directions being orthogonal to each other, the modified light beam being round shaped;

interpreting information received by the laser receiver from the modified light beam, by separating individual sweeps in a sequence of sweeps and interpreting the information in each individual sweep; and translating the interpreted information into a simulated projectile or missile engagement coordinate and outcome.

* * * * *